US006601851B1

(12) United States Patent
Sakamoto et al.

(10) Patent No.: US 6,601,851 B1
(45) Date of Patent: Aug. 5, 2003

(54) CARD GAME TOY FOR USE IN A BATTLE GAME

(75) Inventors: Yoshio Sakamoto, Kyoto (JP); Norikatsu Furuta, Kyoto (JP); Kenji Imai, Kyoto (JP); Hironobu Suzuki, Kyoto (JP); Makoto Katayama, Kyoto (JP); Koichi Kishi, Kyoto (JP); Yumiko Morisada, Kyoto (JP); Hiroshi Tanigawa, Kyoto (JP)

(73) Assignee: Nintendo CO., Ltd., Kyoto (JP)

( * ) Notice: Subject to any disclaimer, the term of this patent is extended or adjusted under 35 U.S.C. 154(b) by 0 days.

(21) Appl. No.: 09/714,864

(22) Filed: Nov. 17, 2000

(30) Foreign Application Priority Data

Nov. 18, 1999 (JP) ..... 11-328877
Feb. 19, 2000 (JP) ..... 2000-105667

(51) Int. Cl.[7] ..... A63F 1/00
(52) U.S. Cl. ..... 273/308; 273/292
(58) Field of Search ..... 273/308, 292

(56) References Cited

U.S. PATENT DOCUMENTS 5,435,568 A * 7/1995 Black
5,662,332 A * 9/1997 Garfield
6,017,034 A * 1/2000 Hennessey

OTHER PUBLICATIONS

Pelland et al., "Pokemon Trading Card Game for Game Boy, Official Player's Guide", Nintendo of America, Inc., 1999, pp. 1–99.

* cited by examiner

*Primary Examiner*—Benjamin H. Layno
(74) *Attorney, Agent, or Firm*—Nixon & Vanderhye, P.C.

(57) ABSTRACT

A card game toy includes a master card as an other self of a player and a plurality of monster cards, and is used for a card game that a battle is played by placing own and opponent cards in a proper positions of a battle field. The master card includes a character display portion to display a character, an ability-reducing indication to indicate an ability to reduce the attack power from the opponent, and a card-hand-ability indication to indicate an ability to use a card hand. The monster card includes a character display region to display a character, a position indication indicative of whether of a forward type or backward type, a physical-power indication indicative of a physical-power of the monster, and an ability indication indicative of an ability of the monster.

19 Claims, 10 Drawing Sheets

CARD GAME TOY FOR USE IN A BATTLE GAME

FIELD OF THE INVENTION

This invention relates to card game toys. More particularly, the invention relates to a card game toy to be used in a card game for playing a battle game using cards having a predetermined battle ability against opponent cards. Winning or losing involves competition to reduce the power of an opponent card to zero.

BACKGROUND AND SUMMARY OF THE INVENTION

Card games such as "POKEMON CARD" (commodity name), which is produced and sold by applicants' assignee, are well known. A card game POKEMON CARD is a card game which includes monster character cards as battle cards and energy cards showing the particular energy required for the monster card to make an attack on the opponent. The offensive player is allowed to take a monster or energy card out of a card group comprising a predetermined number of monster and energy cards. The monster card is summoned as a battle card into a battlefield so that a predetermined energy card is put on the monster card in order to attack an opponent monster card thereby damaging the opponent card. By damaging an opponent card at a predetermined number of points or higher, the opponent monster card may be defeated. Thus, a player who is first to defeat the opponent's monster cards by a predetermined number wins the game.

In the conventional card game, however, a battle is waged with cards that have been selected by the respective players on a one-to-one basis. Accordingly, there is little freedom in choosing a monster card for attacking or an opponent monster card to be battled against. Consequently, even where an energy card is unavailable in the card hand for making an attack with a player's own monster card or where an opponent monster card to be defeated is not present in the battle field, the player is forced to battle against the opponent card. Thus, there are situations where the battle must take place despite a player being aware that a card battle result would be not in favor of the player.

Therefore, it is a feature of the exemplary embodiments to provide a novel card game toy.

Another feature of the exemplary embodiments is to provide a card game toy where a battle game is played between a plurality of cards within a battle field so that the player has increased freedom in selecting a battle card thereby enhancing game interest and strategy.

A further feature of the exemplary embodiments is to provide a card game toy where strategy is enhanced by introducing the concept of position or distance between battle cards.

A further feature of the exemplary embodiments is to provide a card game toy where the rules of a game are simplified by making a single medium "stone" into an energy source required to summon a monster card or use a magic card.

A further feature of the exemplary embodiments is to provide a card game toy where, even when the monster card is attacked by an opponent and reduced in power to zero, tension can be provided in a game due to an increased difference in master-card power value by returning the "stone" to provide an energy source.

A card game toy according to the exemplary embodiments is a card game using at least a first card representative of a first attribute and a second card representative of a second attribute. The first card includes the following respectively formed on one main surface: a first character display region to depict a figure showing a first character representative of the first attribute; a first physical-power indicating part formed in a region excluding the first character display region which indicates first physical-power information on the first character; a first ability indicating part formed in a region excluding the first character display region which indicates first ability information on the first character; and a first range indicating part formed in a region excluding the first character display region which indicates first range information indicative of a range over which an ability of the first character covers. The second card includes the following respectively formed in one main surface; a second character display region to depict a figure representative of a character showing a second attribute; a second physical-power indicating part formed in a region excluding the second character display region which indicates second physical-power information on the second character; a second ability indicating part formed in a region excluding the second character display region which indicates second ability information on the second character; and a second range indicating part formed in a region excluding the second character display region which indicates second range information showing a range over which an ability of the second character covers.

Specifically, the word "Front" is shown in the first range indicating part to show the first card is to be positioned in a forward position and the word "Back" is shown in the second range indicating part to show the second card is to be positioned in a backward position.

In an embodiment, the first and second cards are both monster character cards wherein the first card is a forward positioned monster and the second card a back positioned (backward) monster. The forward monster is positioned in the forward position in the battlefield to exert an attack power on an opponent's forward monster positioned in an opponent's forward position. The backward monster is positioned in a backward position and can make attack on an opponent's forward monster positioned in an opponent's forward position. Furthermore, the backward monster, in some cases, can attack an opponent's backward monster positioned in an opponent backward position. By thus using the first and second cards which are different in their attributes (i.e. range of attack), it is possible to have a novel battle different from a conventional card game. Accordingly, the card game can be played with enhanced strategy.

If the first card and/or second card is formed with a physical-power indicating part for change depending on a character level or an ability information indicating part for change depending on character level, it is possible to play a card game using the first card and/or second card changing in physical power or ability depending on a level.

Also, if at least one card of the first card and/or second card indicates information about a physical power or ability of a character, it is possible to use one card in two ways.

In one aspect of the exemplary embodiments, the card game toy further comprises a third card different in use and purpose from the first and second cards and exhibiting a third attribute used as a representation of a player. The third card forms a third character display region to depict an illustration of a character representing the player. In a region excluding the third character display region, depicted are physical-power information associated with the third character and ability information associated with the third character. In this embodiment, the third card is a master card. In this aspect of the exemplary embodiments, the player uses two kinds of monster and master cards to play a card game.

In a preferred exemplary embodiment of the invention, the card game toy further includes a fourth card representative of a fourth attribute. This fourth card, if in the embodiment, is a magic card wherein the first and second cards are monster cards and the third card is a master card. The card game toy according to the exemplary embodiment is a card game toy for playing a game using a plurality of each of at least three kinds of cards, i.e. first attribute cards, second attribute cards and third attribute cards. The first attribute card forms a first attribute character display region to depict an illustration specifying a kind of a first attribute character. In a region excluding the first attribute character display region, depicted are physical-power information of the first attribute character, ability information of the first attribute character and further first range information indicative of a range over which the ability of the first attribute character covers. The second attribute card forms a second attribute character display region to depict an illustration specifying a kind of a second attribute character. In a region excluding the second attribute character display region, depicted are physical-power information of the second attribute character, ability information of the second attribute character and further second range information indicative of a range over which the ability of the second attribute character covers. The third attribute card forms a third attribute character display region to depict an illustration a character representative of an other self of a player. In a region excluding the third attribute character display region, depicted are physical-power information of the third attribute character and ability information of the third attribute character. A card game toy is thereby obtained that can be played using two kinds of monster cards and one kind of master card.

A card game toy according to an exemplary embodiment is a card game toy for playing a card game describing game information on one main surface and using a plurality of each of at least four kinds of attribute cards, i.e. a first attribute card, a second attribute card, a third attribute card and a fourth attribute card. Indicative objects, such as stones, are used in this embodiment.

In this preferred exemplary embodiment, two players place master and monster cards in the battlefield and, as required, prepare stones as an energy source. One player selects a magic card from the card hand to use magic to the player's own monster card or an opponent's monster card, selects the player's own monster card to attack an opponent's master card or monster card. Such attack is alternately made by the players to alternate between offense and defense. A player who reduces the opponent's master-card-physical-power value to zero is the victor, and the game ends.

According to the exemplary embodiments, a battle is waged between cards in the battlefield thereby providing the player with a wide range of battle card selection to enhance game interest and game strategy.

Also, the card-game strategy can be further enhanced by introducing the concept of position or distance between battling cards.

Furthermore, game rules can be simplified by reducing master-card physical power, monster-card level and energy source required in summoning a master card or using a magic card into a single medium of "stones".

Also, even when the monster card is attacked by an opponent and reduced in physical power to zero, the "stones" thereof can be returned as a player's own energy source. This can provide tension in playing with proper timing due to the difference in physical value between the master cards.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1A:
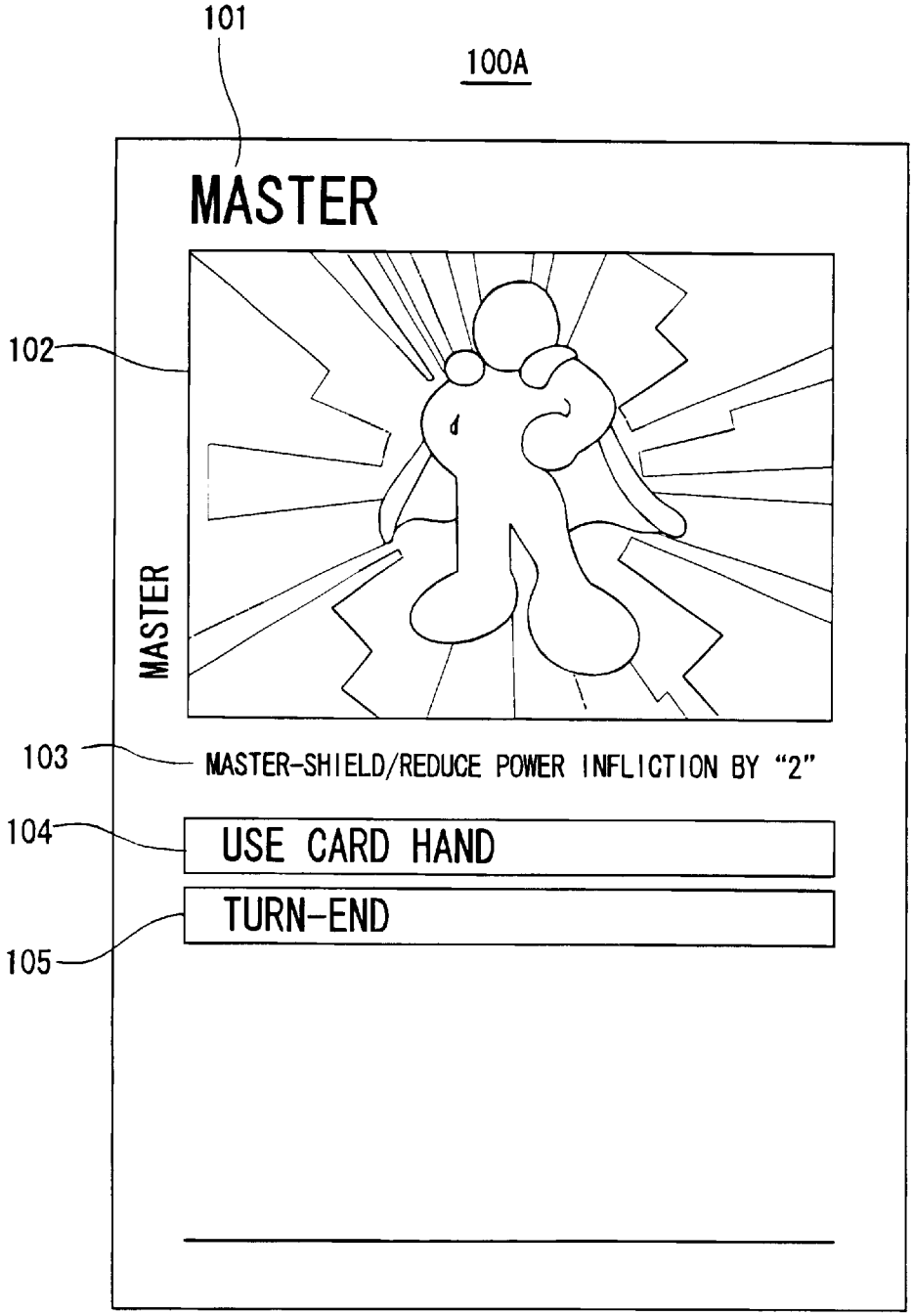
FIG. 1A–FIG. 1D are illustrative views showing a master card included in one embodiment of this invention.
Figure 1B:
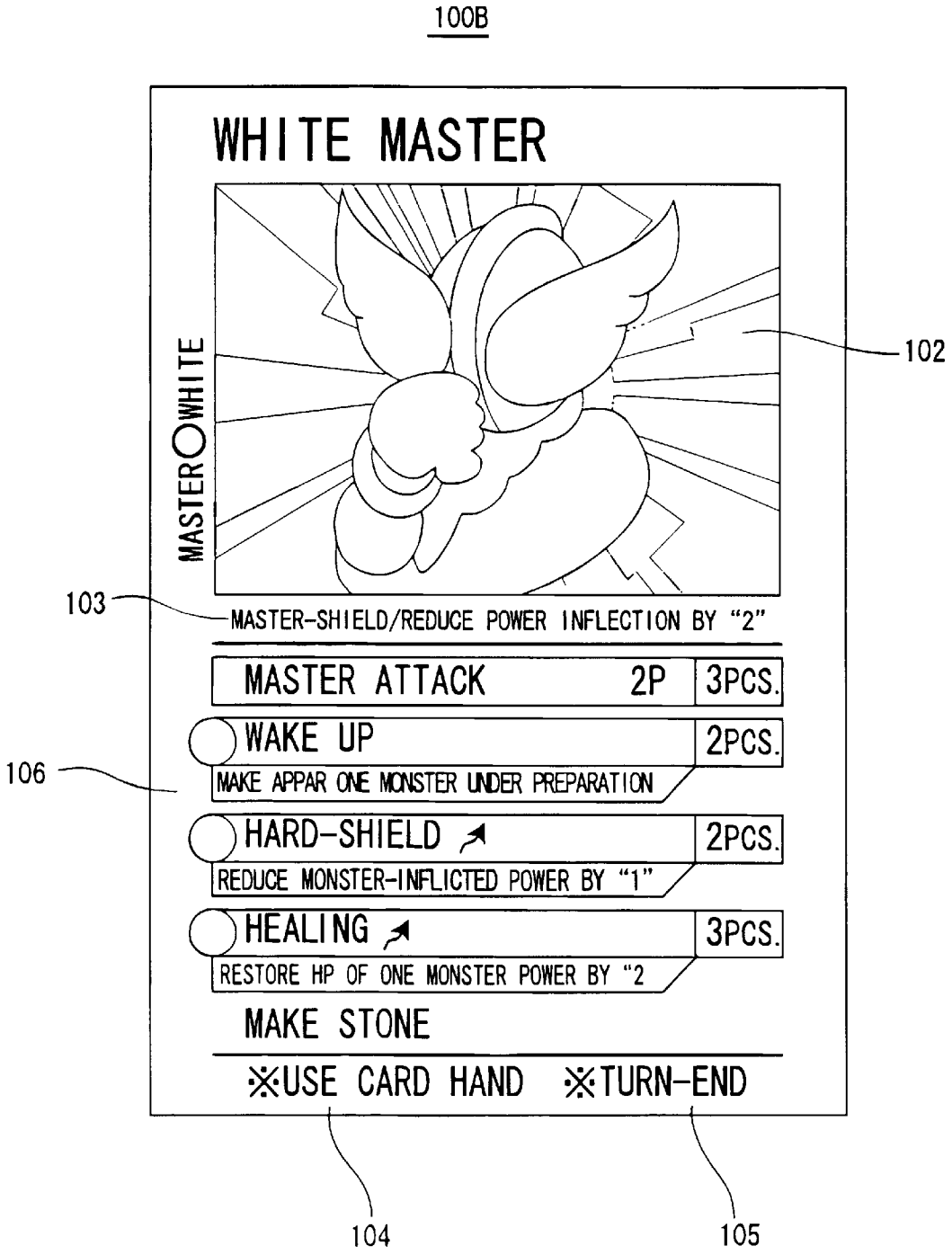
Figure 1C:
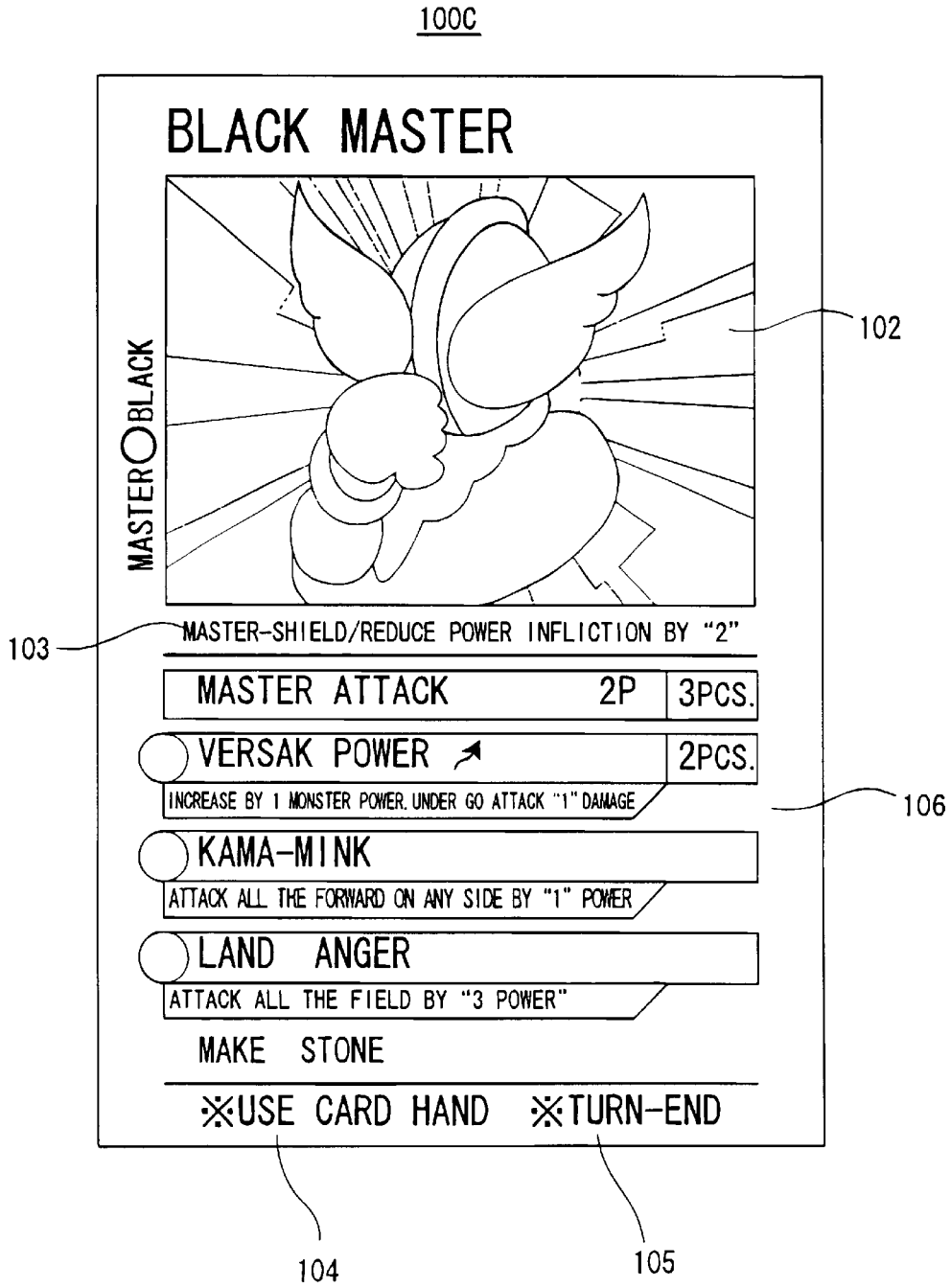
Figure 1D:
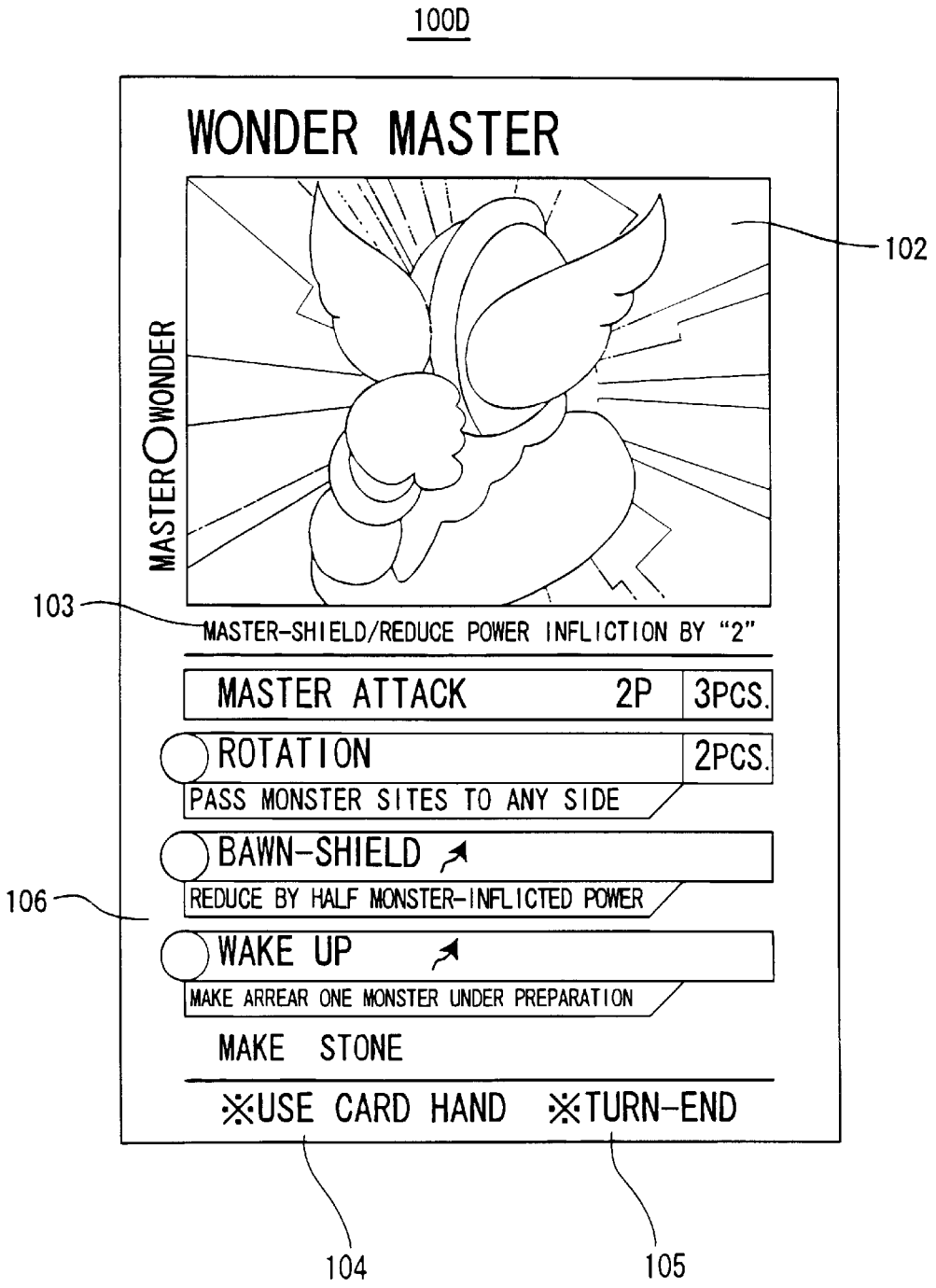
Figure 2A:
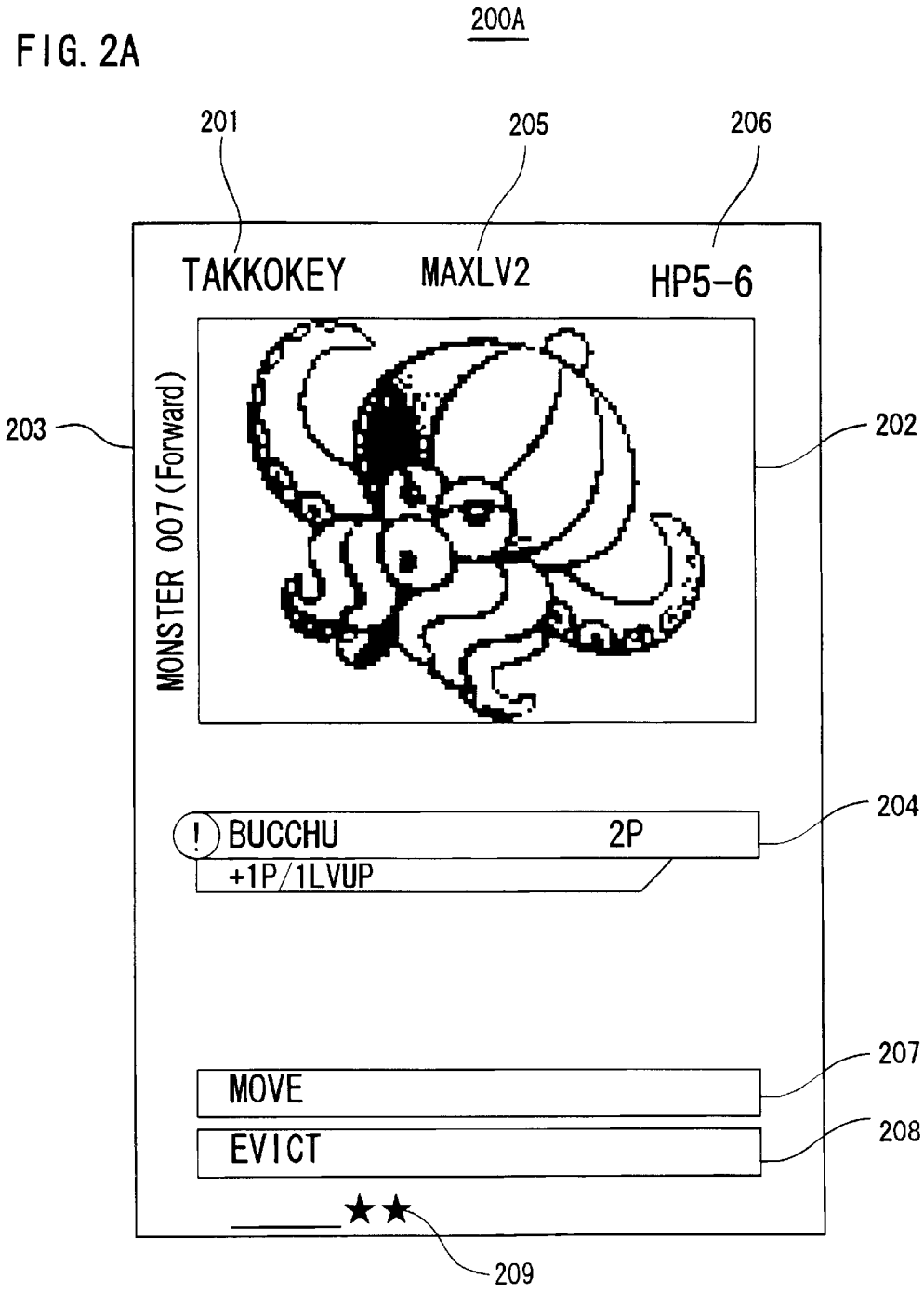
FIG. 2A–FIG. 2C are illustrative views showing a monster card included in the embodiment.
Figure 2B:
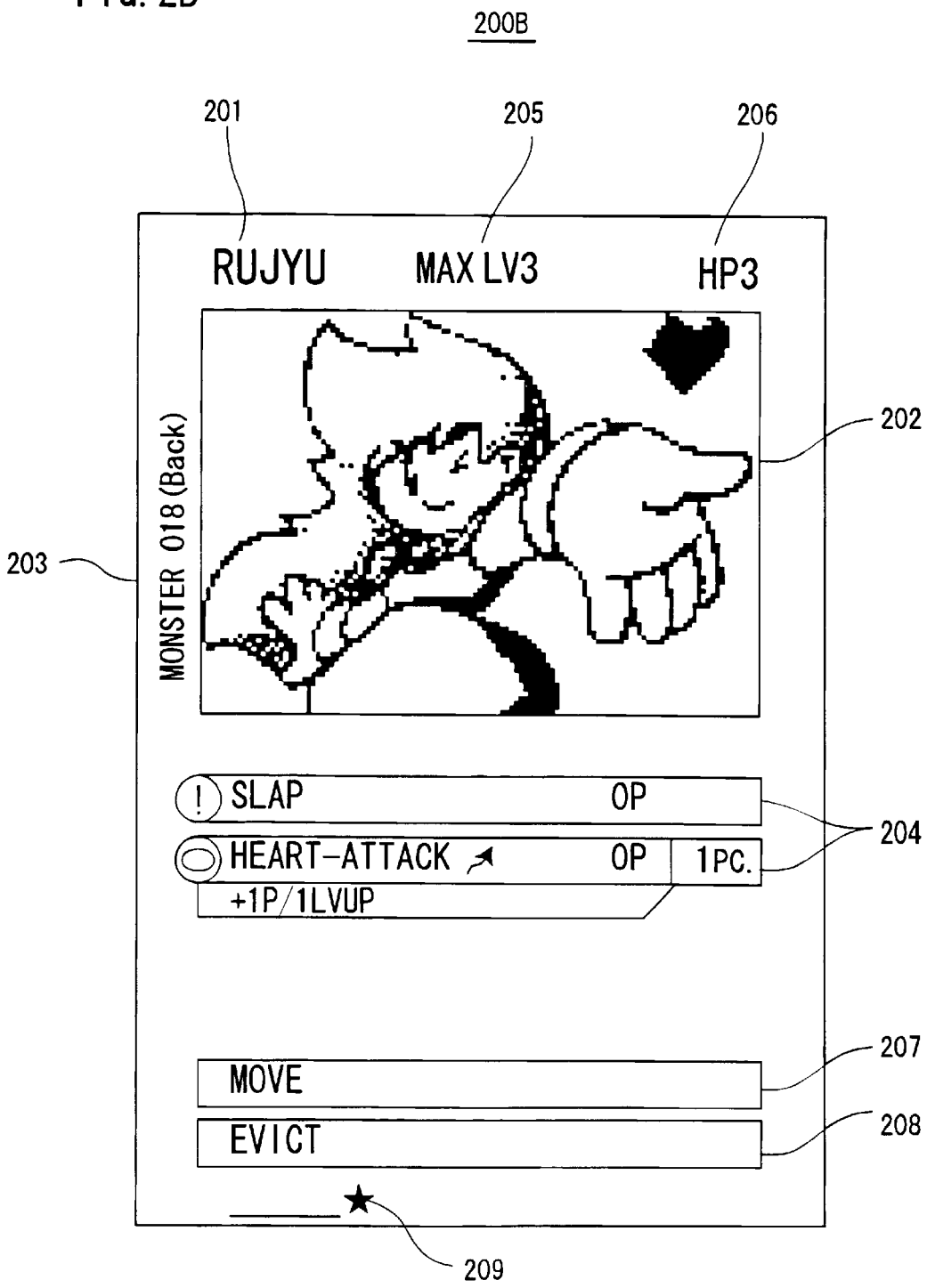
Figure 2C:
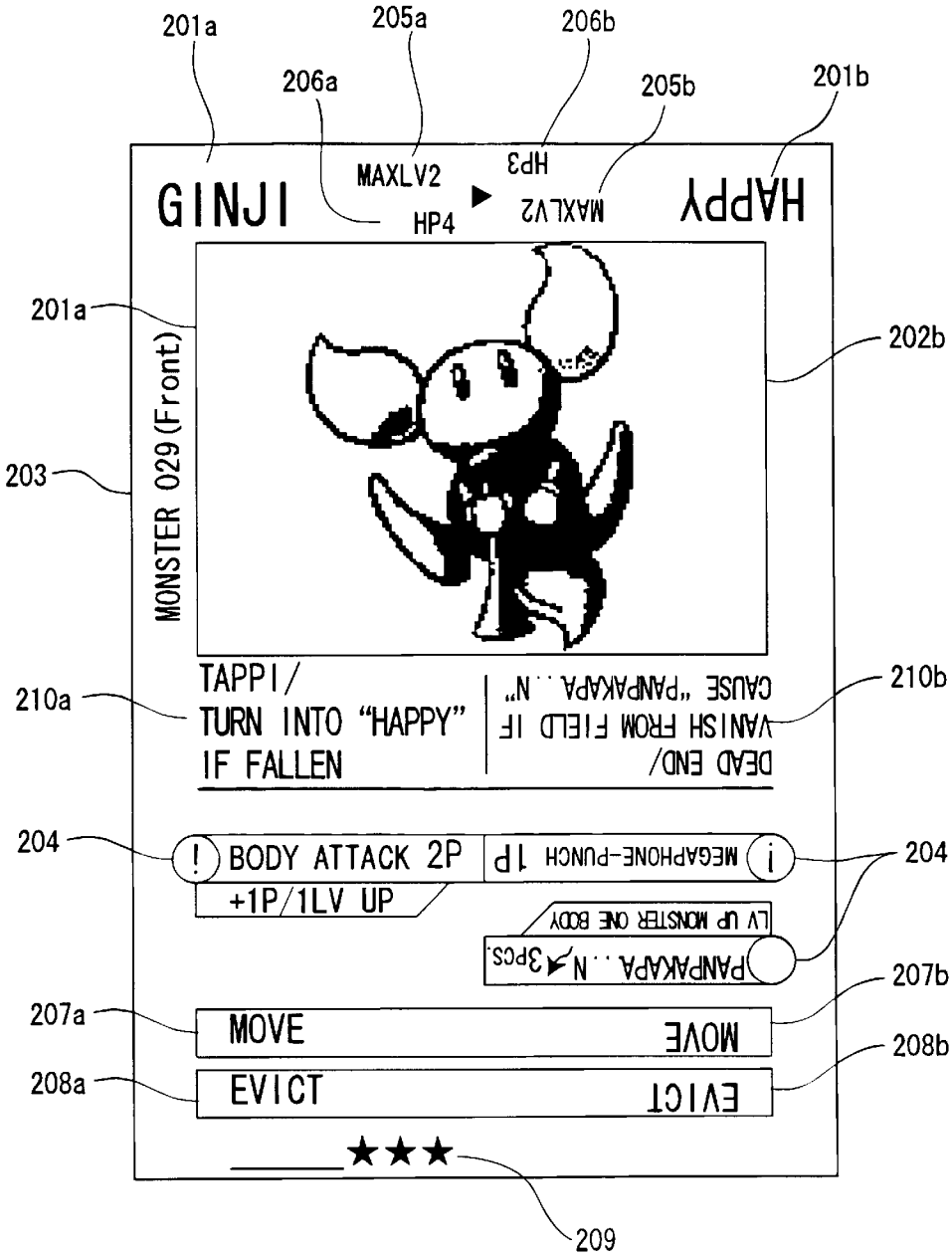
Figure 3A:
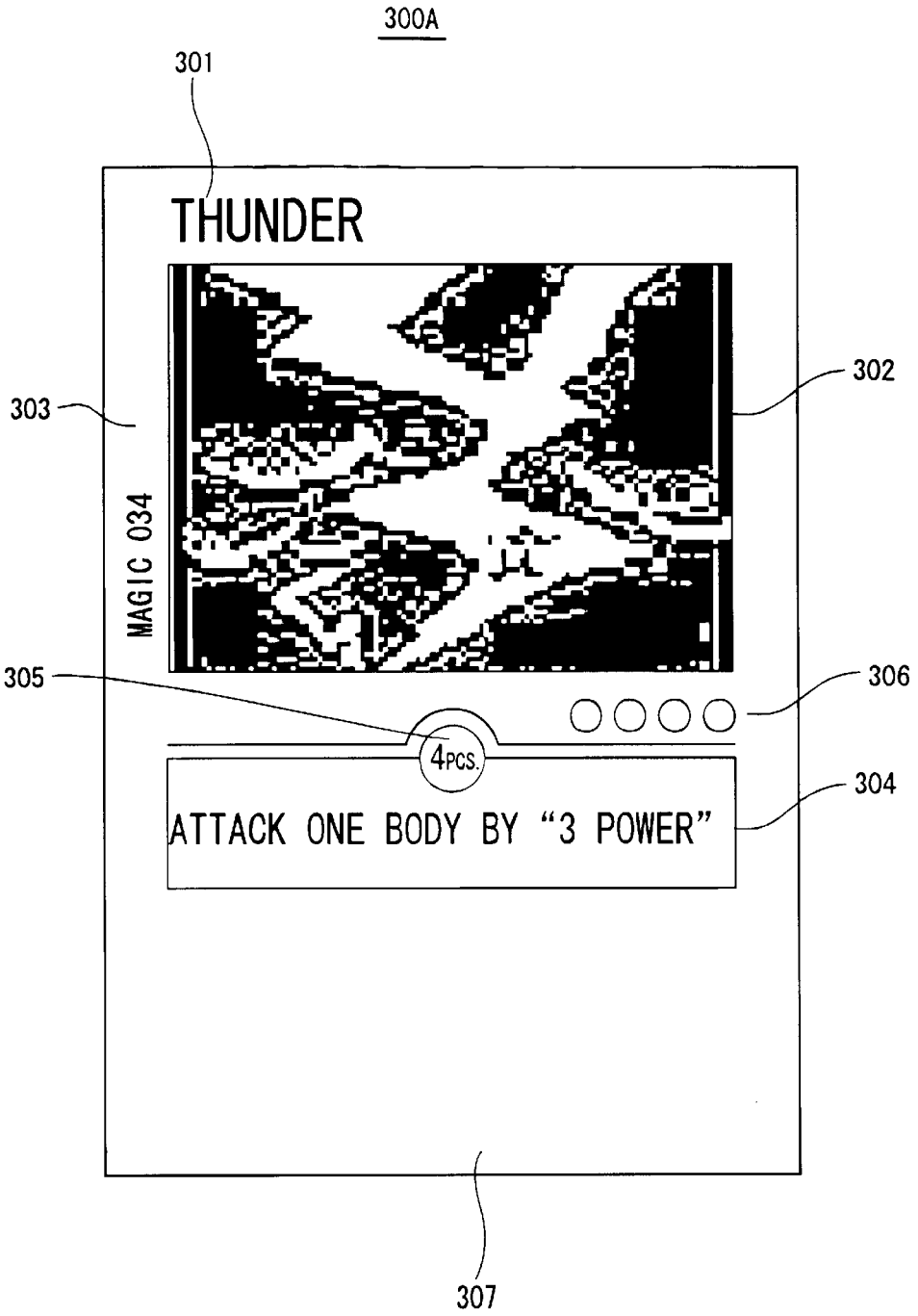
FIG. 3A and FIG. 3B are illustrative views showing a magic card included in the embodiment.
Figure 3B:
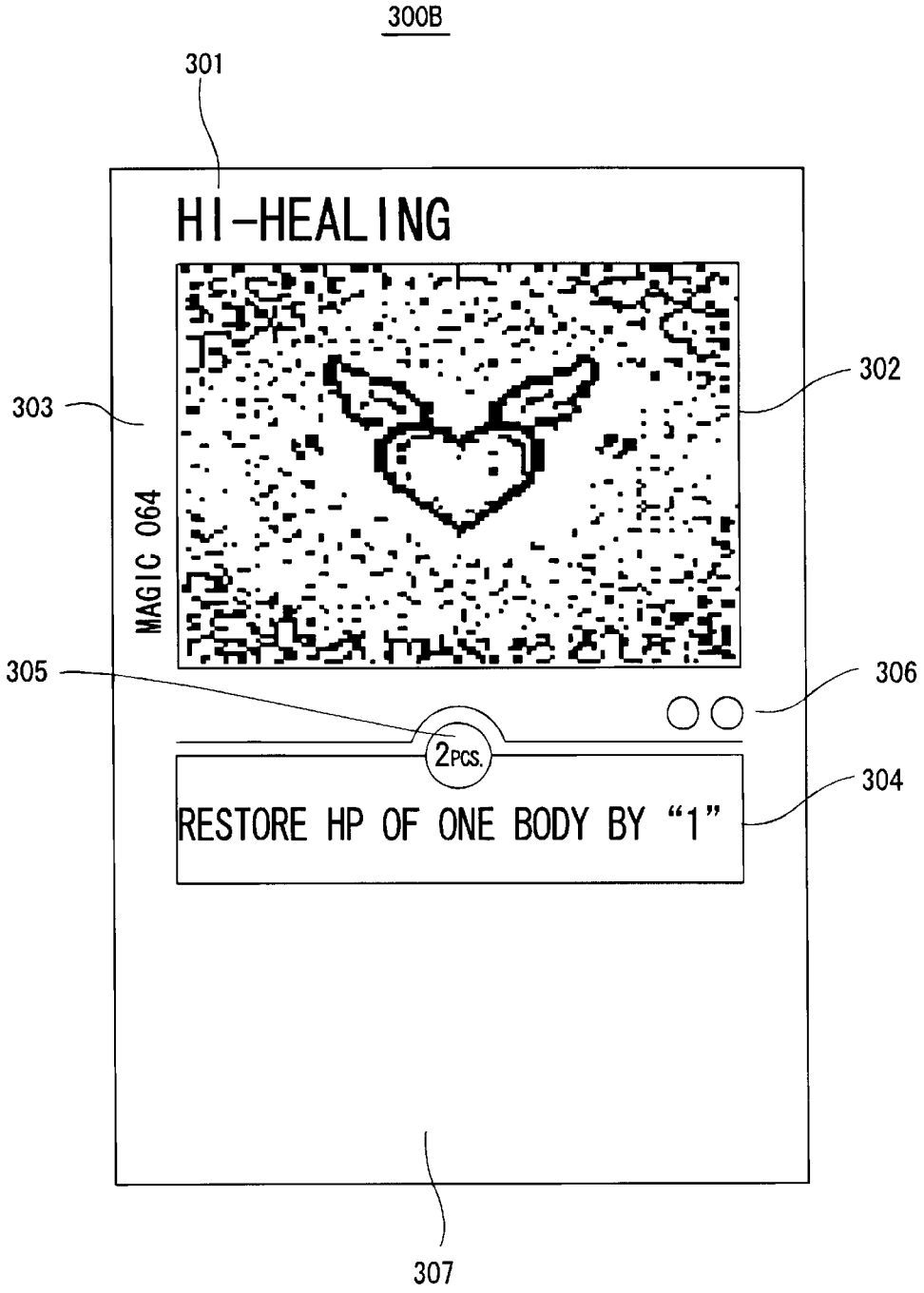

A card game toy of an embodiment according to this invention includes exemplary master cards shown in FIG. 1A–FIG. 1D, exemplary monster cards shown in FIG. 2A–FIG. 2C, and exemplary magic cards shown in FIG. 3A–FIG. 3B.

Referring to FIG. 1A–FIG. 1D, master cards 100A–100D (hereinafter, these master cards when collectively referred to may be identified by the reference numeral "100") are cards to be turned into a representation of a player in order to battle against a opponent's master card or monster card (FIG. 2A–FIG. 2C). That is, the master card is a card having an ability of using a hereinafter-described monster card or magic card in order to battle against an opponent player. Consequently, the master card 100 shown in FIG. 1A–FIG. 1D is, at least, identified as a master card and displayed with information representative of an ability to use a hand card. The indication as a master card is given by the word "MASTER" and/or by depicting a figure of a character representative of the master. In place of this, however, a portrait or picture of a player may be used.

Figure 4:
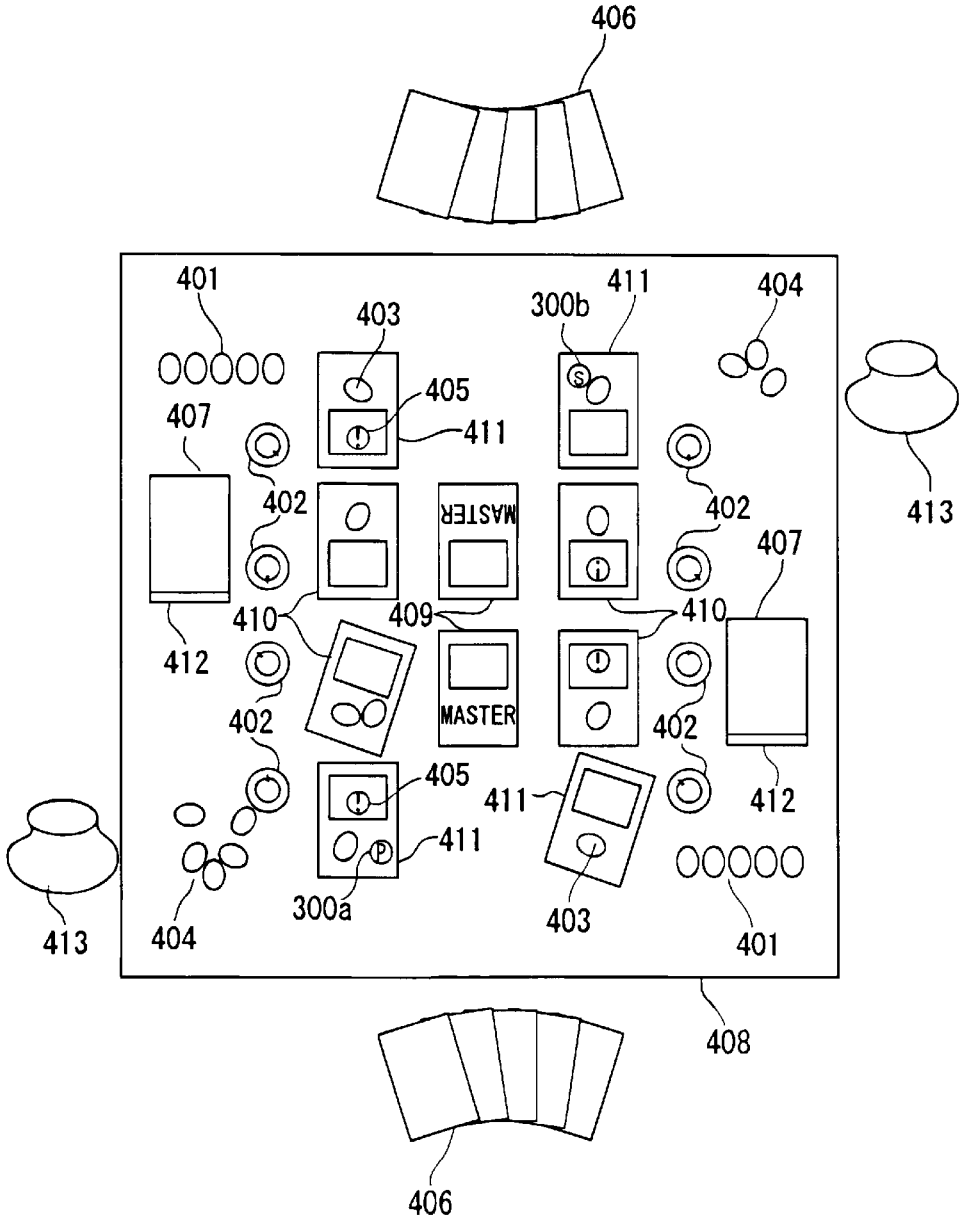
FIG. 4 is an illustrative view showing an entire battle filed in a card game using the card game toy of the embodiment.

In the embodiment shown in FIG. 1A–FIG. 1D, the master card 100A–100D is formed with a display region 102 having a picture or figure of a master character. Above this display region 102, a master-indicating part 101 is formed where the word "MASTER" is written in order to identify a master card. Below the display region 102, ability indicating parts 103, 104 and 105 are formed to indicate an ability of the master card. The ability indicating part 103 indicates an ability to reduce the power of the master card 100 attacked by an opponent card (e.g. "2P": note that P means a power). The ability indicating part 104 indicates an ability to use a hereinafter-described monster card 100 or magic card 300 as a hand card 406 (FIG. 4). The ability indicating part 105 indicates an ability to end a player's own turn to pass to the opponent (this is referred to as "turn-end").

The master card 100 includes particular-ability master cards having an ability to attack opponent cards or use magic on other cards, in addition to the mere master (100A) indicating the above information. In this embodiment, such cards are a white master 100B shown in FIG. 1B, a black master 100C shown in FIG. 1C and a wonder master 100D shown in FIG. ID. The mere master 100A does not have an ability to attack opponent card or to use magic on other cards. However, the white master 100B, black master 100C and wonder master 100D, are particular-ability type master cards, and have other ability-indicating card fields 106 to indicate having an attack ability to damage an opponent monster card or an ability to use a magic to restore the power of a player's own monster card, etc. These master cards 100 (100A–100D) are made available depending upon the game kind or method. For example, if the master card is made available when grading up from "junior" to "senior" or "pro" as the level of the game difficulty increases, and it is possible to enjoy a higher variation game card.

Referring to FIG. 2A–FIG. 2C, monster cards 200A–200C (hereinafter, these monster cards when collectively referred to may be identified by reference numeral "200") are cards to attack an opponent's monster cards or master cards. Consequently, the monster card 200 is, at least, formed with a character display region 202 to display a picture or figure of the monster card. In the upper left of the character display region 202, a name display part 201 is formed written with a monster name. In the upper right of the character display region 202, a power indicating part 206 is formed to describe a numeral representative of a power (HP) of the monster card. Below the character display region 202, a power indicating part 204 is formed to indicate a power of the monster card. On the power indicating part 204, the ability information possessed by the monster card is indicated by letters and a numeral (symbol).

Specifically, the monster card 200 may be one of two kinds of monster cards depending upon the position to which the monster card is to be placed. There is a first monster card placed in a forward position (first card exhibiting a first attribute) and a second monster card placed in a back position (second card exhibiting a second attribute).

In this embodiment, a card 200A of a monster "TAKKOKEY" shown in FIG. 2A is a forward (FRONT) card. "TAKKOKEY" is labeled in the name indicating part 201 to indicate it is a monster kind of card. Below, a figure like an octopus is depicted in the character display region 202 showing a posture of the monster character. In the letter indicating part 203 at the left of the character display region 202, "MONSTER 007" is indicated to show that this card is a monster card with a card number of "007". Also, part 203 includes letters "FORWARD" meaning that this monster card is a "Forward type" card, i.e. this card is a first card. That is, this card is preferably positioned in the forward position in view of the ability of this monster card. However, the player is allowed to freely place this card in the backward or back position.

In the ability indicating region 204 below the character display region 202, described is a word "BUCCHU" representing an attack method, "2P" representing an attack power and "+1P/1LVUP" representing information indicating an attack force depending upon a level. A sprit-amassing indication "!" has a meaning such that, when a monster card summoned in the battle field is not used in one's own turn, the attack power is increased by "1P" in the player's next turn to have an ability for reducing an attack power of an opponent by "1P". The letters "BUCCHU" is an indication of an attack method unique to the monster "TAKKOKEY". The information described in the letter indicating part 204 for indicating attack ability differs depending upon the kind of a monster. There is a unique attack ability depending upon a description content (monster kind). The symbols "2P" represent an attack power such that the attack power is "2 power". The indication "+1P/1LVUP" means that, when the level of a monster increases by "1", then the attack power is increased by "+1P", i.e. by "1 power". "MAXLV2" in the level indicating part 205 indicates the maximum level of a monster wherein a maximum level of this monster is "2".

"HP5–6" indicated in the monster physical-power indicating part 206 identifies "HP5" at a level 1 and "HP6" at a level 2.

The indicator "MOVE" in the ability indicating part 207 identifies an ability to move the card from one position to another place.

The monster card indicator "EVICT" in the ability indicating part 208 identifies having an ability to vanish oneself away from the battle field.

A monster value indicating part 209 indicates a rare value of the relevant monster card by virtue of the number of star marks. The more star marks the higher rarity value.

Next, explanation is given of a backward or back monster "RUJYU" with reference to the monster card 200B shown in FIG. 2B. In the name indicating part 201, "RUJYU" depicts a monster kind of card. In the character display region 202, depicted is a posture of the monster character "RUJYU". In the letter indicating part 203 at the left of the character display region 202, are letters "MONSTER 018 (Back)". This represents a monster card having a card number "018", wherein the letters "Back" indicates this monster card is a "backward type" or "back positional" type.

The ability indicating fields 204 includes a symbol of spirit-amassing indication "!", letters "SLAP" indicating an attack method unique to this monster, and "0P" indicating that the attack power is "0P" at level 1.

The ability indicating field 204 indicates to attack with "Heart attack" at an attack power of "1P" on the opponent card when in level 1. The arrow mark pointing up and to the right shown to the right of the letters "HEART-ATTACK" indicates to exert an attack power not only to an opponent forward monster but also to a backward monster or master card even if this monster card is placed in either of the forward or backward position. That is, in a battlefield shown in FIG. 4, attack power can be exerted to all the spaces (card placing positions) 409, 410 and 411.

Meanwhile, the letters "+1P/1LVUP" in the ability indicating part 205 indicate that the attack power increases by "1P" as the level is increased by 1, similarly to the monster card "TAKKOKEY".

The letters (1PC) "1 PIECE" to the right end of the ability indicating part 204 indicates the number of stones 404 (hereinafter referred) required in making attack. Incidentally, an illustration of this stone is shown on the left of the "Heart attack" letters.

The letters "MAXLV3" in the level indicating part 205 shows that the monster has a maximum level of "3". Also, the monster physical-power indicating part 206 shows a maximum physical power of "HP3". Consequently, the monster "RUJYU" has an attack power of "1P" at level 1, "2P" at level 2 and "3P" at level 3. The physical power, in any level, is "HP3" shown in the maximum physical-power indicating part 217. The letters "MOVE" in the ability indicating part 207 and the letters "EVICT" in 208 are similar to those of the monster "TAKKOKEY".

This monster has one star in the monster value indicating part 209 and hence is lower in rarity value than TAKKOKEY.

Next, explanation is given for a monster character "GINJI/HAPPY" with reference to a card 200C shown in FIG. 2C. This monster card has an ability of two monster characters. This card is determined such that its ability is changed when the physical power (HP) becomes zero due to attack by an opponent. For this purpose, the monster card 200C is depicted with two figures of monster characters "GINJI" and "HAPPY" in the character display region 202. Note that this monster card 200C is used with the position inverted by 180 degrees and only "Happy" is shown in FIG. 2C because only one character is to be viewed in one direction. That is, although the character display region 202 of this monster card 200C displays two characters in opposite directions to each other, only one character can be seen when viewed in one direction.

The names ("GINJI" and "HAPPY") of two monster characters are included in the name indicating parts 201A and 201B while the letters (MONSTER 029(Front)) indicative of a monster kind of card are described in the monster indicating part 203 to the left of the character display region 202*b*. Below the character display region 202*b*, are ability indicating parts 204*a*, 204*b*, 207*a*, 207*b*, 208*a*, 208*b*, 210*a* and 210*b*.

In the ability indicating part 204*a*, identified are an attack method "BODY ATTACK" by the monster character "GINJI," a spirit-amassing indication "!", an attack-power indication "2P", letters "+1P/1LVUP" indicating an increase in attack power depending upon a level and so on.

To the right of the name indicating part 201*a*, are letters "MAXLV2" in the monster maximum level indicating part 205*a* and letters "HP4" in the monster maximum physical-power indicating part 206*a*. Also, in the ability indicating parts 207*a*, 208*a* and 210*a* in a left half part, letters "MOVE", "EVICT" and "TURN INTO "HAPPY" if TAPPI/FALLEN DOWN" are indicative of abilities of the monster "GINJI".

In the ability indicating part 204*b* on the right side, are letters of an attack method "MEGAPHONE-PUNCH" of the monster character "HAPPY" and a spirit-amassing indication "! ", an attack power indication "1P", a monster ability indication "PANPAKAPA . . . N" and its ability content indication "MAKR MONSTER-1-BODY LVUP." and the letters 3PCS ("3 PIECES") as the number of stones required.

To the left of the name indicating part 201*b*, "MAXLV2" is a monster maximum level indicating part 205*b* and "HP3" in a monster maximum physical-power indicating part 206*b*. Also, in the ability indicating parts 207*b*, 208*b* and 210*b* in a right half of the card, described are letters of "EVICT", "MOVE" and "ONLY ONCE/DISAPPEAR FROM FIELD IF CAUSING "PANPAKAPA.N" that are indicative of abilities of the monster "HAPPY".

In this manner, the monster "HAPPY" depicted in the right half of the monster card 200C and its ability and physical power indications are displayed in a direction 180 degrees opposed to the monster "GINJI" depicted in the left half and its ability and physical-power indications. "TAPPI/BECOME HAPPY IF FALLEN DOWN" in the ability indication 210*a* means that, if the physical power (HP) becomes zero due to attack by the opponent, the monster "GINJI" 201*a* turns into a monster "HAPPY" 201*b* through 180-degree inversion.

The monster card 200C shown in FIG. 2C has the feature of turning into another monster through inversion by 180 degrees. However, two monsters may be displayed in the upper and lower part of the card or four monsters may be displayed respectively in four-divided regions at the upper, lower, left and right, thereby turning them into other monsters each time the card is rotated 90 degrees.

Because three stars are indicated in a monster value indicating part 209 of the monster card 200C, this monster card 200C has a rarity value higher than the "RUJYU" card 200B having one star or the "TAKKOKEY" card 200A having two stars.

Referring to FIG. 3A and FIG. 3B, explanations will be given for magic cards 300A and 300B (hereinafter, these magic cards when collectively referred to will be identified by reference numeral "300").

A magic card 300 is a card to use magic against an opponent card or for a player's own card. Consequently, this magic card has, at least, an indication that it is a magic card, an indication as to a content of magic used against an opponent card or for a player's own card, and the energy required to use the card. This magic card 300 are of a variety of kinds, wherein a magic method, and a selection-level indication, i.e. the number of stones used, are different depending upon the kind of magic card. In this embodiment are shown a magic card "THUNDER" "300A (FIG. 3A) has associated magic for attack and a magic card "HI-HEALING" 300B (FIG. 3B) has associated magic for restoration.

In a name indicating part 301 of the magic card 300A, the letters "THUNDER" indicates that the card is a kind of magic card. In a character display region 302, a picture or figure of a magic character "THUNDER" is displayed. The indication "MAGIC 034" in an indicating part 303 identifies this card is a magic card with a card number "034". The kind of magic is shown in a magic indicating part 304. This example shows an attack ability of "attacking a card 1 body by "3 POWER". Energy indicating parts 305 and 306 indicate the number of stones 404 (FIG. 4) required as energy for using magic against an opponent's card by selecting this card-magic card 300A from a card hand 406 (FIG. 4). This example shows that four stones are required. The "THUNDER" of this magic card 300A exhibits power particularly when attacking an opponent master card. That is, although attack must be by a power of "3P" or higher in order to reduce the physical power of a master card by "1", the direction of this "THUNDER" allows attack with "3P" thus making it possible to reduce the physical power of the opponent master card by "1".

In a name indicating part 301 of a magic card "HI-HEALING" 300B, the word "HI-HEALING" indicates that the card as a kind of magic card. In a character display region 302, displayed is a picture or figure of "HI-HEALING" as a magic character. In a letter indication part 303, the symbol "MAGIC 064" indicates that this card is a magic card with a card number "064". The letters in the magic indicating part 304 and the numerals and figures in the energy indicating parts 305 and 306 show that the magic is for "restoring the physical power (HP) of the card 1 body by "1"" if consuming two stones 404 (shown in FIG. 4).

The magic cards include a magic card having an effect for a constant period (e.g. during each turn of the first player or second player or only once) wherein the letters on that matter or the like are described on such a card.

FIG. 4 is an illustrative view showing a card game layout using a card game toy of the above embodiment. Referring to FIG. 4, explanation is given where a card game battle is played using a plurality of master cards 100, monster cards 200 and magic cards 300.

A battle field includes, as shown in FIG. 4, master-card depositories 409 provided in a center thereof for respective players, forward monster card depositories 410 provided at the left and right of each player's master-card depositories 409, and backward monster card depositories 411 in positions on the player side of the monster-card depositories 410. The depositories of stones 401 for providing physical power to the master card 100 are arranged to the right of the backward monster card depository 411 as viewed from each player's perspective. The depositories of stones 404 for providing an energy source to the monster card are arranged to the left of the backward monster card depository 411. Furthermore, the deck spaces 412 for placing a deck 406 are fixed for each player.

Although the embodiment of FIG. 4 is an example of a game where battle play occurs using five stones as a maximum physical power of the master card, the number of stones is not necessarily limited to five but may be determined freely between the players. Also, the stones 401 in this embodiment are shown by marbles as an example. However, they may be anything provided that they are to be counted and common to the hereinafter-referred stones 401 and 404. For example, use may be stone-resembling toys, coins, dice, tags or torn-off pieces of paper.

Counters 402 are used to show a numeral of a physical power indication (HP) of a monster card 200, which in the FIG. 4 example indicates a numeral via a dial. The counter value is different depending on a monster kind, to which are applied the numerals of "HP" in the physical-power indicating parts 206 and 206*a* and 206*b*. The counter 402 may use anything provided that a physical-power numeral is counted. Besides counters, toys resembling stones like the stones 401, 403 or 404, marbles, coins, dice, tags or torn-off pieces of paper may be utilized, or a paper sheet may be used to write numerals thereon.

The stones 403 placed on a monster card represent a level of the monster card 200. That is, the number of stones 403 indicates a level number of the monster card 200. This stone 403 may be replaced with others similar to the case of the stones 401 and 404 provided that it can be moved as a stone 401, 404.

The number of stones 404 represents energy quantity (number), and are used to summon one's own monster card 200 to a battle site, increase the level of a monster card 200, select a monster card 200 summoned in a battle site to attack an opponent's monster, or select a magic card 300 to exercise magic. These stones 404 are provided three each time a turn comes. The stones 404 may be represented by marbles as an example but may be replaced with other objects similar to the stones 401 and 403 provided that they are counted and moved as stones 401 and 403. Also, from the above example, the stones 401, 403 and 404 are mutually moved and hence use a common material.

The material on display 405 is a "spirit-amassing indication" showing a mark "!". The material on display 405 may be anything understood by the players, and may be medals, cards or marbles, dice, tags or the like.

The card hand 406 is constituted by monster cards 100 or magic cards 300 that are drawn from the deck 407. At the game beginning stage, the card hand is constituted by five cards. However, there is no necessity for five hand cards drawn from the deck 407 in the game beginning stage. The number may be determined between the players.

The deck 407 is shuffled with various kinds of monster cards 200 and magic cards 300 to be used the game. The number of monster cards 100 and magic cards 300 forming the deck 407 is not particularly limited but should provide a range of variety allowing the game to be played. By dividing the level of game difficulty and kind into four types of "junior rule", "senior rule", "pro rule" and "gamble rule", the number of cards constituting respective decks 407 may be changed, e.g. 15, 20, 30, 20, depending upon the type of game.

Also, when winning a battle over an opponent, a monster card or magic card not in the hand may be provided from the opponent. An extension pack as a separately available card set may be purchased to introduce new monster cards or magic cards to the deck 407 thereby increasing the variation of attacks and associated enjoyment.

A battle board 408 provides a battlefield for playing the game. The battle board 408 uses, as materials, clothes, plastic, paper and the like. Also, a stone bag 413 is for storing stones to be used as stones 401, 403, 404.

Next, explanation is given where the battle game may be enjoyably played using a card game toy of this embodiment. The master cards 100 are placed in the master card depositories 409 of the battlefield 408 from the beginning of the game.

The monster cards 100 are cards capable of "attacking" an opponent's monster card 200 or master card 100, "defending" one's own monster card 200 or master card 100, "moving" a monster card 200 in position within the battle field 408, or "evicting" a monster card 200 from the battle field. "Attacking" refers to decreasing the physical power (HP) value when attacking an opponent's monster card 200, specifically reducing the value on the counter 402. Where attacking an opponent's master card 100, it is referred to as reducing the physical power thereof, specifically reducing the number of stones 401. "Defending" refers to reducing the power of attack when a player's own monster card 200 undergoes attack from the opponent. "Moving" refers to movement in position 410, 411 of a monster card 100 to another position 410, 411. "Eviction" refers to removal of a monster card 200 from a battlefield 408. Incidentally, it is possible as a way to use a monster card 200 is to intentionally attack and defeat one's own monster card 200 or defend an opponent card in order to increase the number of stones 404 as an energy source. Note that, when intentionally attacking one's own monster card 200 in order to increase the number of stones 404 referred herein, the stones 403 showing a level of the monster card 200 will return to one's own stones 404, wherein the physical power of the master card 100 decreases by "1" and one stone 401 vanishes from the battle field. This is referred to as a "penalty".

The monster cards 200 are separately arranged in the forward and the backward positions. In the FIG. 4 embodiment, the forward refers to monster spaces 410, 411 while backward to monster spaces 410, 411. The monster card 200 positioned in the forward position is referred to as a "forward type" while the monster card 200 positioned in the backward position is referred to as a "backward type". The forward type has a high physical power and attack power, and is good at storming with human bullets. Specifically, it principally makes attack on an opponent forward monster or master. The backward type, despite being low in physical power and attack power, is designed to attack from a distant place. Specifically, this card can attack, beyond one's own forward monster cards, a monster card 200 or master card 100 positioned in the opponent forward. The monster cards 200, in some kinds, can attack reaching an opponent's backward monster card 200. The player is allowed to position a "forward type" monster card 200 in the backward position, and position a "backward type" monster card 200 in the forward position.

Next, an explanation is given as to the relationship between level, physical power and attack power when using the monster cards 200. For example, "RUJYU" of FIG. 2B, has a level "1" when initially summoned to a battle field and only one stone 403 is placed on this monster card. The monster card has a physical power of "HP3", an attack power of "slapping" of "0P", and an attack power of "heart attack" of "1P". That is, an attack power of "slapping" is not available in level 1 wherein an attack of "Heard attack" can decrease the physical power of an opponent card by "1". In order to increase from the level 1 to level 2, when the physical power in level 1 of an opponent monster card can be increased to "HP0", the stone 403 put on the opponent card turns into an opponent stone 404 and a stone 403 is added from the own stones 404 to one's own monster, thereby providing an increase to level 2.

In level 2, the attack power of "RUJYU" in "heart attack" is given "2P". Also, similarly to level 3, the "heart attack" becomes "3P". However, because there is no level-up indication in any level of "slap" attack, the attack power remains "0P". Because the maximum level 205 of this monster card 200B is "MAXLV3", there is no possibility of increasing to level 4 or higher. Also, in any of the levels 1 to 3, the physical-power indication 217 is "HP3" thus always being "3". Also, because this monster is indicated with "1piece", the number of stones 404 required to attack the opponent is one.

The monster card 200 includes a variety of types. Depending upon the type, there is a difference in select level, attack method, attack power and physical power. Although the monster level singly in that monster does not become a level shown in the maximum level indication "MAXLV–" or higher, there are some cards that become a higher level than that shown in the display by adding another monster card.

The magic card 300 is selected from a card hand 406 drawn from the deck 407 similar to the monster card 200, and is used to apply magic to an opponent's monster card 200 or master card 100 or a player's own monster card 200 or master card 100. However, this card will not be summoned to a battlefield different from the monster card 200. The magic includes, depending upon the kind, those for lowering the attack power of an opponent's card, increasing the attack power of a player's own monster card 200, reducing the damage suffered depending upon attack from the opponent, and so on.

When selecting a magic card 300 and applying magic to a card, there is a need to use stones 404 of a number according to a selection level indicated on the magic card 300. In accordance with the kind of a magic card 300, declaration may be made on that matter, placement may be made face up on or under or in the vicinity of the card to be used with magic. Other indicative objects such as medals 300*a*, 300*b* other than the cards or stones may be used.

The stones 401 are decreased in number each time the master card 100 undergoes attack from the opponent and is reduced in physical power. For example, if the master card 100 undergoes attack with "3P" (3 power) from the opponent, because the master card 100 has an ability of "reducing the power undergone to 2", the attack is offset by "2P" and the physical power decreases by the remaining "1P". That is, one stone will be lost from the stones 401. Also, for example, if the master card is attacked with "5P" from the opponent, the attack is offset by "2P" and the physical power decreases by "3P" thus losing three stones from the stones 401. The stones lost herein will move to the hereinafter-referred stones 404. The player who is first to reach zero in the number of the stones 401 is defeated.

The value on the counter 402 decreases in accordance with the attack power by the opponent. For example, where a monster having a counter value of "HP5" is summoned to a battlefield but attacked with "3P" from the opponent, the counter value becomes "HP2". Furthermore, if attacked with "2P" from another opponent's monster, then the counter value becomes "HP0". This means that the physical power of the monster becomes zero and hence is defeated. The same monster will disappear from the battlefield.

The stones 403 represent a level number of a monster card 200 are used as follows. The monster card 200 summoned from a card hand 406 is usually in level 1, i.e. the number of stones 403 is one. However, when attacking an opponent's monster card 200 in level 1 and decreasing its physical power to zero for defeat, the player's own monster card 200 in attacking can become "2" in level. Whether increasing the level or not is at the player's option. In this case, the stones 403 for the opponent's monster card 200 which is attacked and defeated are moved as own energy source to the stones 404. The monster card 200 attacked and defeated the opponent monster card 200 acquires one stone from the stones 404 as one's own energy force. Due to this, the monster card 200 defeating the opponent's monster in the battle becomes level 2 thereby increasing the stones 403 to two. However, rising to level 2 is impossible when there is no own energy-source stone 404. When defeating an opponent's monster card having level 2 or two stones 403, the two stones turn into stones 404 as opponent energy force. The monster card 200 defeating the opponent monster can increase from level 1 to level 3 by moving to stones from the player's own energy source 404. Note that the monsters in kind include those free from level change and those having a maximum level of up to level 2, and accordingly the level is not always increased in order.

Three stones 404 are taken out of the stone bag 413 in one's own turn at the beginning of the game. When a monster card 200 is summoned from a card hand 406 into a battlefield 408, usually one stone is needed. Accordingly, one stone 404 is consumed by the player. The stone 404 is positioned on the summoned monster card 200. Also, the cases provided with the stones 404 include the following besides the case providing three for each turn. That is, when the physical power of a player's own master card 100 is reduced by attack from the opponent card, the stones in a number corresponding to the decreased number of stones 401 are provided. When a player's own monster card 200 is reduced to zero and is defeated by attack from an opponent card and the number of stones 403 is decreased, stones in the number corresponding to the decreased number of stones 403 are provided.

The material on display 405 is a "spirit-amassing indication". When the monster card 200 summoned to a battlefield and in a face-up selectable state is not selected during turn, the material on display is placed on or under or in the vicinity of the card 200. The monster card 200 indicated with material on display 405, in player's own next turn, increases a particular attack power by "1P" and decreases the attack power from the opponent by "1P".

The card hand 406 is on the hand such that an opponent player cannot see it during play of the game. In the beginning of the game, five cards are taken in order from a shuffled deck 407 to have a card hand. Also, each time the opponent's turn ends and the player's own turn comes, one card at one time is taken out of the deck 407 to constitute a card hand 406.

The stone bag 413 is used to take out three stones therefrom when it is the player's turn to have stones 404. When attacking one's own monster card 200 to make the stones 403 as an energy source 404 for calling or selecting other monster cards, when a so-called "penalty" is imposed, one stone 401 as a physical-power indication of the master card 100 vanishes and the same stone is returned to the stone bag 413.

Next, the card game process is explained. First, each player shuffles a deck 407 comprising a group of various cards and place the deck 407 with the card positioned face down on the space 412 of the battle board 408.

Then, both players draw five cards in order from the top of the deck 407 to have respective card hands 406. The five cards comprise monster cards 200 and/or magic cards 300. The card hand 406 is the card on hand and is not to be seen by the opponent. The first five cards drawn can be re-drawn only once. Also, the master card 100 is placed from the beginning of the game in the master space 409, which can be placed by freely selecting from the masters of "BLACK", "WHITE" and "WONDER".

Then, the both player play janken (paper-scissors-stone), lot or the like to determine who is first or second to play in the game.

Then, both players are each given three stones 404 as an energy source to be used in summoning or selecting a monster card 200 or selecting a magic card 300 or the like. These stones 404 are taken out three at one time out of the stone bag 413 each time a turn comes.

The first player obtains a card hand 406 is allowed to summon a monster card 200 or select a magic card 300 from the five cards. When summoning a monster card 200 to a battle field from the card hand 406, the monster card 200 is positioned face down so that its monster indication is not seen and placed at a space 410, 411 to be summoned. One stone is taken from the stones 404 to put on or under or in the vicinity of the card, thus having a stone 403. The positioning of the card face down is not to select the monster card 200 when in summoned turn. Also, the number of the stones 403 placed represents a level number of the monster card 200. The space 410, 411 where the monster card 200 is summoned is freely selectable by the player. However, because the monsters include those which exhibit power as forward and those which exhibit power as backward as stated before, usually the monster card 200 if "forward type" in kind should be positioned in the space 410, 410 and if "backward type" be positioned in the space 411, 411.

When selecting a magic card 300, magic can be used to a player's own card or an opponent's card by the use of stones 404 in the number depending upon a selection level indicated on the card. When selecting the magic card 300 to use magic desired by the player and attacking or defending a desired card, declaration on that matter is made in accordance with a kind of magic card 300 and it is placed face up on or under or in the vicinity of a card when the magic is used. Also, it is possible to use indicative objects other than the cards or stones, e.g. coins or medals, such as medals 300*a*, 300*b*.

As an example of selecting a magic card 300, for example, when a magic card "THUNDER" 300A is selected to attack an opponent master card 100, four stones 404 are used to declare that event. Also, when selecting a magic card "HARD-SHIELD" to utilize the effect of reducing the attack power of the opponent by "1", it may be positioned on or under or in the vicinity of a player's own monster card 200 to be defended or a medal indicative of that matter is placed on the card 200.

When the first player ends the summoning or selecting of a desired card or the stones 404 as an energy source for summoning or selecting are reduced to zero, own turn ends. This is referred to as "turn-end".

Due to the turn-end, the second player is allowed to summon a monster card 200 or select a magic card 300 from the five cards. The way of card summoning or selection is similar to that of the first player. When a desired card has been summoned or selected or the stones 404 as an energy source have been reduced in number to zero, the turn of the second player ends resulting in turn-end.

When the first player's turn comes again due to the turn-end of the second player, the monster card 200 summoned in the battle field and positioned face down is turned face up so that the monster card 200 is rendered in a selectable state. When there is a vacancy space 410 immediately in front of the monster card 200 positioned in the space 411 on a second row, the same card 200 is tuned up and at the same time the card must be moved to the vacant space 410. At this time, the first player who is given three stones 404 from the stone bag 413 and drew one card from the deck 407 to newly obtain one hand card can use the stones 404 to select the monster card 200 summoned to the battle field 408 in the previous turn and attack an opponent monster card 200 or master card 100, to newly summon a monster card 200 from the card hand 406 to the battle field, to select a magic card 300 from the card hand and attack an opponent card or defend an own card. In a game with a difficulty level higher than "senior rule", it is possible to utilize a card of "WHITE", "BLACK" or "WONDER" master shown in FIG. 1A–FIG. 1D. Also, the player can move the monster card 200 from a current position 410, 411 to another position 410, 411 for the purpose of preparing for attack by the opponent or on the opponent. The monster card 200 once selected and moved is usually not allowed to select or move in that turn.

Also, when a player's turn ends without selecting the monster card 200 summoned in the previous turn and positioned face up in the current turn, an indicative object 405 is put as "spirit-amassing indication" to the monster card 200. If the summoning or selection of a desired card ends, turn-end is made to pass the turn to the opponent.

In this manner, the turn of card summon, attack, etc. is repeated. The winner is the one who is first to render the physical power of the opponent master card 100, or stones 401 to zero. Thus the game ends.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A card game toy for playing a card game between first and second players which involves the relative position of the first player's cards with respect to the position of the second player's cards on a battlefield comprising:

a first card including a first character display region to depict a figure representing a first character having a first attribute; a first physical-power indicating part to indicate first physical-character information associated with the first character; a first ability indicating part to indicate first ability information associated with the first character; and a first range indicating part to indicate first range information indicative of a range over which an ability of the first character covers on the battlefield relative to the positions of the first and second players' cards, and a second card including a second character display region to depict a figure representing a second character having a second attribute; a second physical-power indicating pan to indicate second physical-power information associated with the second character; a second ability indicating part to indicate second ability information associated with the second character; and a second range indicating part to indicate second range information showing a range over which an ability of the second character covers on the battlefield relative to the positions of the first and second players' cards, wherein said first card and said second card are to be placed in proper positions within the battlefield, said first range information and said second range information respectively including first position designating information and second position designating information to designate placement positions of said first card and said second card within the battlefield, and wherein said first position designating information includes indicia on the card indicative of a forward placement position relative to the placement positions of other cards on the battlefield and said second position designating information includes indicia on the card indicative of a backward placement position relative to the placement positions of other cards on the battlefield.

2. A card game toy according to claim 1, wherein at least one card of at least one of said first card and said second card includes level indicating information and a change-physical-power information indicating part indicative of physical-power information for change depending upon the level indicating information of said first character and said second character.

3. A card game toy according to claim 1, wherein at least one card of at least one of said first card and said second card includes level indicating information and a change ability information indicating part to indicate ability information for change depending upon said level indicating information of said first character and said second character.

4. A card game toy according to claim 1, wherein said first character display region displays figures of at least two types of said first character or said second character in a first region and second region, at least one of said first physical-power information indicating part and said first ability indicating part concerning one type of first character being formed in said first region, and at least one of first physical-power information indicating part and said first ability information indicating part concerning another type of a first character being formed in said second region.

5. A card game toy according to claim 1, wherein said first character display region displays figures of at least two types of said first character or said second character in a first orientation and second orientation, at least one of said first physical-power information indicating part and said first ability indicating part concerning one type of first character being formed in the first orientation, and at least one of said first physical-power information indicating part and said first ability information indicating part concerning the other type of first character being formed in the second orientation.

6. A card game toy according to claim 1, further comprising a third card different in purpose from said first card and said second card and representative of a third attribute to be used as representing a player, said third card including a third character display region to depict a figure representing a third character representing the player; and a third ability information indicating part to indicate third ability information associated with said third character.

7. A card game toy according to claim 6, further comprising a fourth card representative of a fourth attribute, said fourth card including at least one of a fourth character display region to depict a figure showing a fourth character to use magic on said first, second and third cards and a fourth ability indicating part to indicate a fourth ability information associated with said fourth character.

8. A card game toy according to claim 6, further comprising a fourth card representative of a fourth attribute, said fourth card including at least one of a fourth character display region to depict a figure representing a fourth character to use magic on any of said first to third cards and a fourth ability indicating part to indicate fourth ability information associated with said fourth character.

9. A card game toy for playing a card game between first and second players which involves the relative position of the first player's cards with respect to the position of the second player's cards placed on a battlefield comprising:

a first type of card including a first character display region to depict a figure representing a first character representative of a first attribute; a first physical-power indicating part to indicate first physical-power information associated with said first character; a first ability indicating part to indicate first ability information associated with said first character; and a first range indicating part to indicate a range over which an ability of said first character covers on the battlefield relative to the positions of the first and second players' cards, and a second type of card including a second character display region to depict a figure of a second character representing a player; and a second ability information indicating part to indicate second ability information associated with said second character.

10. A card game toy for playing a card game between first and second players which involves the relative position of the first player's cards with respect to the position of the second player's cards placed on a battlefield comprising:

a first card including a first character display region to depict a figure showing a first character representative of a first attribute; a first physical-power indicating part to indicate first physical-power information associated with said first character; a first ability indicating part to indicate first ability information associated with said first character; and a first range indicating part to indicate first range information showing a range over which an ability of said first character covets on the battlefield relative to the positions of the first and second players' cards, a second card including a second character display region to depict a figure showing a character representative of a second attribute; a second physical-power indicating part to indicate second physical-power information associated with said second character; a second ability indicating part to indicate second ability information associated with said second character; and a second range indicating part to indicate a range over which an ability of said second character covers on the battlefield relative to the positions of the first and second players' cards, and a third card including a third character display region to depict a figure of a third character representative of a player; and a third ability information indicating part to indicate third ability information associated with said third character.

11. A card game toy for playing a card game between first and second players which involves the relative position of the first player's cards with respect to the position of the second player's cards on a battlefield comprising:

a first card including a first character display region to depict a figure showing a first character having a first attribute; a first physical-power indicating part to indicate first physical-power information associated with said first character; a first ability indicating part to indicate first ability information associated with said first character; and a first range indicating part to indicate first range information showing a range over which an ability of said first character covers on the battlefield relative to the positions of the first and second players' cards, a second card including a second character display region to depict a figure showing a character having a second attribute; a second physical-power indicating part said second character; a second ability indicating part to indicate second ability information associated with said second character; and a second range indicating part to indicate second range information showing a range over which an ability of said second character covers on the battlefield relative to the positions of the first and second players' cards, a third card including a third character display region to depict a figure of a third character representing a player; and a third ability information indicating part to indicate third ability information associated with said third character, and a fourth card including a fourth character display region to depict a figure showing a fourth character to use magic on any of said first to third cards; and a fourth ability indicating part to indicate fourth ability information associated with said fourth character.

12. A card game toy according to claim 11, further comprising an indicator capable of indicating level information of at least one of said first card and said second card, the third physical-power information on said third card, and energy information required to select any of said first to fourth cards.

13. A card game toy for use in a card game between first and second players where the players play a battle game comprising: a battlefield, a plurality of monster type character cards placed in use within said battlefield, wherein the first player's monster-type character cards are placed on said battlefield and the second payer's monster-type battle cards are placed on the battlefield relative to the placement positions of the first player's monster-type character cards, each of the monster type character cards including a character display region to display a monster character, an ability indicating part to indicate an ability of the monster character, and a position indicating part to indicate where the card must be placed relative to the placement position of other monster-type character cards in the battle field.

14. A card game toy according to claim 13, wherein said position indicating part includes indicia indicative of at least one of a "forward" indication and a "back" indication.

15. A card game toy according to claim 14, wherein at least one of said monster cards includes a stone number indication to indicate the number of stones required for exhibiting the ability of the monster card.

16. A card game toy according to claim 13, further comprising master cards to be placed one by one on said battle field by the two players, each said master card including a character display region to display a master character and an ability indicating part to indicate an ability of said master character.

17. A card game toy according to claim 16, wherein at least one of said master cards includes a stone number indication to indicate the number of stones required for exhibiting the ability of the master card.

18. A card game toy according to claim 16, wherein at least one of said magic cards includes a stone number indication to indicate the number of stones required in exhibiting an ability of said magic card.

19. A card game toy according to claim 13, further comprising magic cards to be placed in said battle field by the two players, said magic cards including at least one of a character display region to display a magic character and an ability indicating part to indicate an ability of the magic character.

* * * * *